United States Patent [19]

Kumata

[11] 4,443,114

[45] Apr. 17, 1984

[54] ELECTRONIC TIMEPIECE WITH MELODY ALARM FACULTIES

[75] Inventor: Kiyoshi Kumata, Tsuzuki, Japan

[73] Assignee: Sharp Kabushiki Kaisha, Osaka, Japan

[21] Appl. No.: 406,577

[22] Filed: Aug. 9, 1982

Related U.S. Application Data

[63] Continuation of Ser. No. 174,511, Aug. 1, 1980, abandoned, which is a continuation of Ser. No. 2,218, Jan. 9, 1979, abandoned.

[30] Foreign Application Priority Data

Jan. 17, 1978 [JP] Japan ..... 53-4076
Mar. 2, 1978 [JP] Japan ..... 53-24267

[51] Int. Cl.[3] ..... G04B 23/02; G04B 21/00
[52] U.S. Cl. ..... 368/73; 368/273
[58] Field of Search ..... 368/72–75, 368/250, 251, 272–273; 84/1.01, 1.03

[56] References Cited

U.S. PATENT DOCUMENTS

| | | | |
|---|---|---|---|
| 3,637,914 | 1/1972 | Hiyama | 84/1.03 |
| 3,840,691 | 10/1974 | Okamoto | 84/1.03 |
| 3,861,263 | 1/1975 | Okudaira | 84/1.03 |
| 4,073,133 | 2/1978 | Earls et al. | 368/273 |
| 4,090,349 | 5/1978 | Takase | 368/156 |
| 4,104,865 | 8/1978 | Sasaki | 368/251 |

*Primary Examiner*—Vit W. Miska
*Attorney, Agent, or Firm*—Birch, Stewart, Kolasch & Birch

[57] ABSTRACT

A melody function of an electronic timepiece is incorporated into a one or more LSI chip. A pseudo or dummy scale frequency signal generator responsive to timing signals is developed from a timekeeping divider chain. In one preferred form an audible alarm sound is provided in the form of a desired melody.

11 Claims, 7 Drawing Figures

ELECTRONIC TIMEPIECE WITH MELODY ALARM FACULTIES

This application is a continuation, of copending application Ser. No. 174,511, filed on Aug. 1, 1980, abandoned which is a continuation of copending application Ser. No. 002,218, filed on Jan. 9, 1979, now abandoned.

BACKGROUND OF THE INVENTION

The present invention relates to an electronic timepiece which provides audible alarm sounds in the form of an appropriate melody.

In a conventional electronic timepiece audible alarm sounds are provided by repeating a single frequency signal from in the middle of multiple divider stages. Such repetition of the same frequency signal causes discomfort to the user.

It is therefore an object of the present invention to provide sweet and agreeable alarms or announcements of time in the form of an appropriate melody.

A primary object of the present invention is to provide an electronic timepiece which develops alarms and announcements of time in an appropriate melody. Another object of the present invention is to simplify circuit construction by taking advantage of timing signals occurring within a timekeeping circuit for the purpose of generating an appropriate melody. Still another object of the present invention is to provide an improved electronic timepiece which develops a desired number of pseudo scale signals for the generation of alarm sounds and announcements of time.

DETAILED DESCRIPTION OF THE INVENTION

Figure 1:
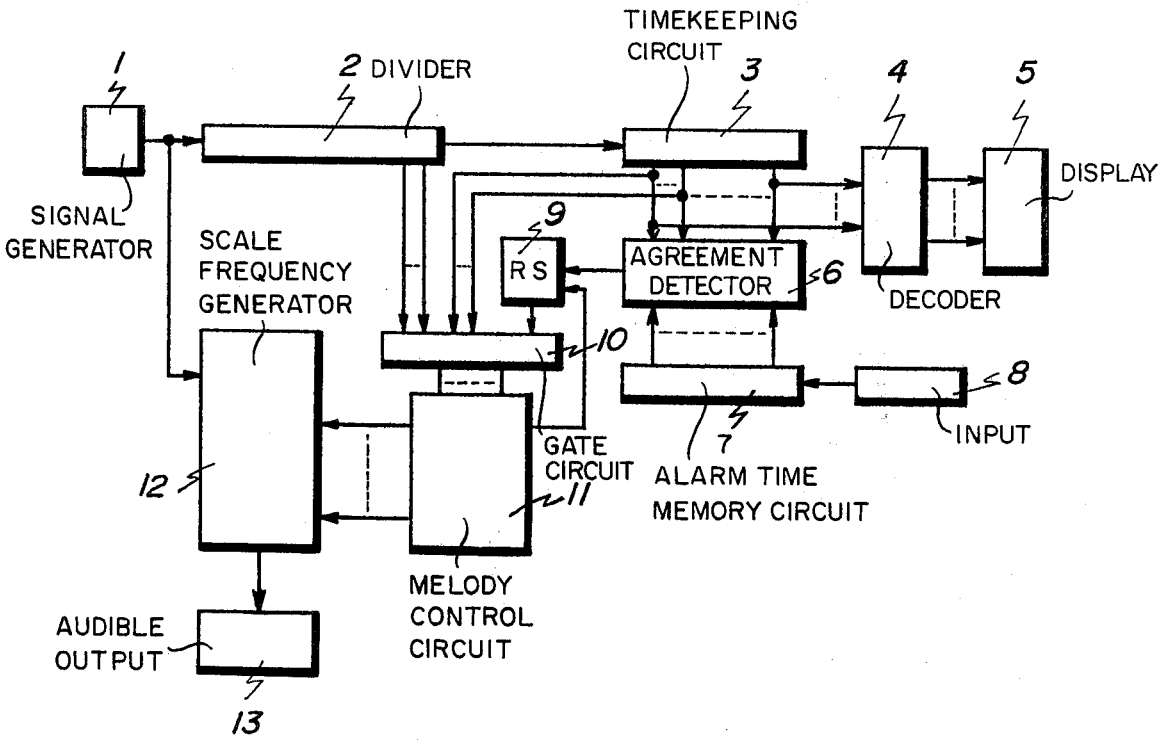
FIG. 1 is a block diagram of one preferred embodiment of the present invention.

Referring now to FIG. 1, there is illustrated one preferred embodiment of the present invention in a block diagram, which comprises a standard signal generator 1, a divider circuit 2, a timekeeping circuit 3, a decoder 4 and a diaplay 5 in a well known manner. The standard signal generator 1 may be implemented with a conventional quartz oscillator to develop a standard signal of 32.768 kHz which in turn is subject to frequency division through the divider 2. The timekeeping circuit 3 responds to the output of the divider 2 to produce a predetermined number of pieces of time information. The respective pieces of time information are sent to the decoder 4 and visually displayed on the display 5 in a well known method.

In the illustrative embodiment there are further provided alarm faculties which comprises an agreement detector 6 receiving the output of the timekeeping counter 3 to sense whether the time information contained within the timekeeping counter 3 agrees with preset time to be alarmed. An alarm time memory circuit 7 is adapted to store the time to be alarmed for comparison purposes and thus receive the alarm time introduced through an input circuit 8 including externally controlled switches. Under the circumstance that the alarm time information is contained within the memory circuit 7, an RS flip flop 9 is forced into the set position upon development of the affirmative answer from the detector 6, turning a gate circuit 10 off for the purpose on developing audible alarm sounds in the form of an appropriate melody.

The gate circuit 10 receives the output from the divider 2 and the output from the timekeeping circuit 3 and supplies these outputs to a melody control circuit 11. As will be clear later, the melody control circuit 11 may be set up by, for example, a programmable ROM (ready only memory) from which musical scale control signals are selected in succession. A scale frequency generator 12 receives the standard signal from the standard signal generator 1 and scale control signals from the melody control circuit 11 and develops pseudo or dummy frequency signals representative of respective scales in accordance with the scale control signals. Details of how to develop the pseudo frequency signals will be discussed later. An audible output circuit 13 may include a loud speaker to develop an appropriate alarming melody in response to the output from the scale frequency generator 12.

Utilization of the standard signal frequency of 32.768 kHz makes it possible to produce apparently similar frequencies representative of respective scales by a combination of simple division ratios as defined Table 1. Table 1 sets forth accurate frequencies representative of the C sound through the C' sounds within the third octave, ratios of frequency division from 32.768 kHz, frequencies indicative of respective pseudo scales and deviations from the accurate frequencies. It will be concluded from Table 1 that the pseudo scales are available within less than ±1.0% of deviation by utilization of a division ratio within a range from 15 to 31. This can be accomplished by at most two different ratios of frequency division.

TABLE 1

| | C | C#(D♭) | D | D#(E♭) | E | F | F#(G♭) |
|---|---|---|---|---|---|---|---|
| accurate frequency (Hz) | 1048 | 1108 | 1176 | 1244 | 1320 | 1396 | 1480 |
| division ratio from 32.768 kHz | 31 | (30 + 29)/2 | 28 | (27 + 26)/2 | 25 | (23 + 24)/2 | 22 |
| pseudo scale frequency (Hz) | 1057 | 1110.8 | 1170.3 | 1236.5 | 1310.7 | 1394 | 1489.5 |
| devision from accurate frequency (%) | +0.86 | +0.25 | −0.48 | −0.6 | −0.7 | −0.14 | +0.64 |
| | G | G#(A♭) | A | A#(H♭) | H | C' | |

TABLE 1-continued

| | | | | | | |
|---|---|---|---|---|---|---|
| accurate frequency (Hz) | 1568 | 1652 | 1760 | 1856 | 1976 | 2096 |
| division ratio from 32.768 kHz | 21 | 20 | (19 + 18)/2 | (18 + 17)/2 | (17 + 16)/2 | (16 + 15)/2 |
| pseudo scale frequency (Hz) | 1560.4 | 1638.4 | 1771.2 | 1872.5 | 1985.9 | 2114 |
| devision from accurate frequency (%) | −0.48 | −0.82 | +0.64 | +0.89 | +0.5 | +0.86 |

Figure 2:
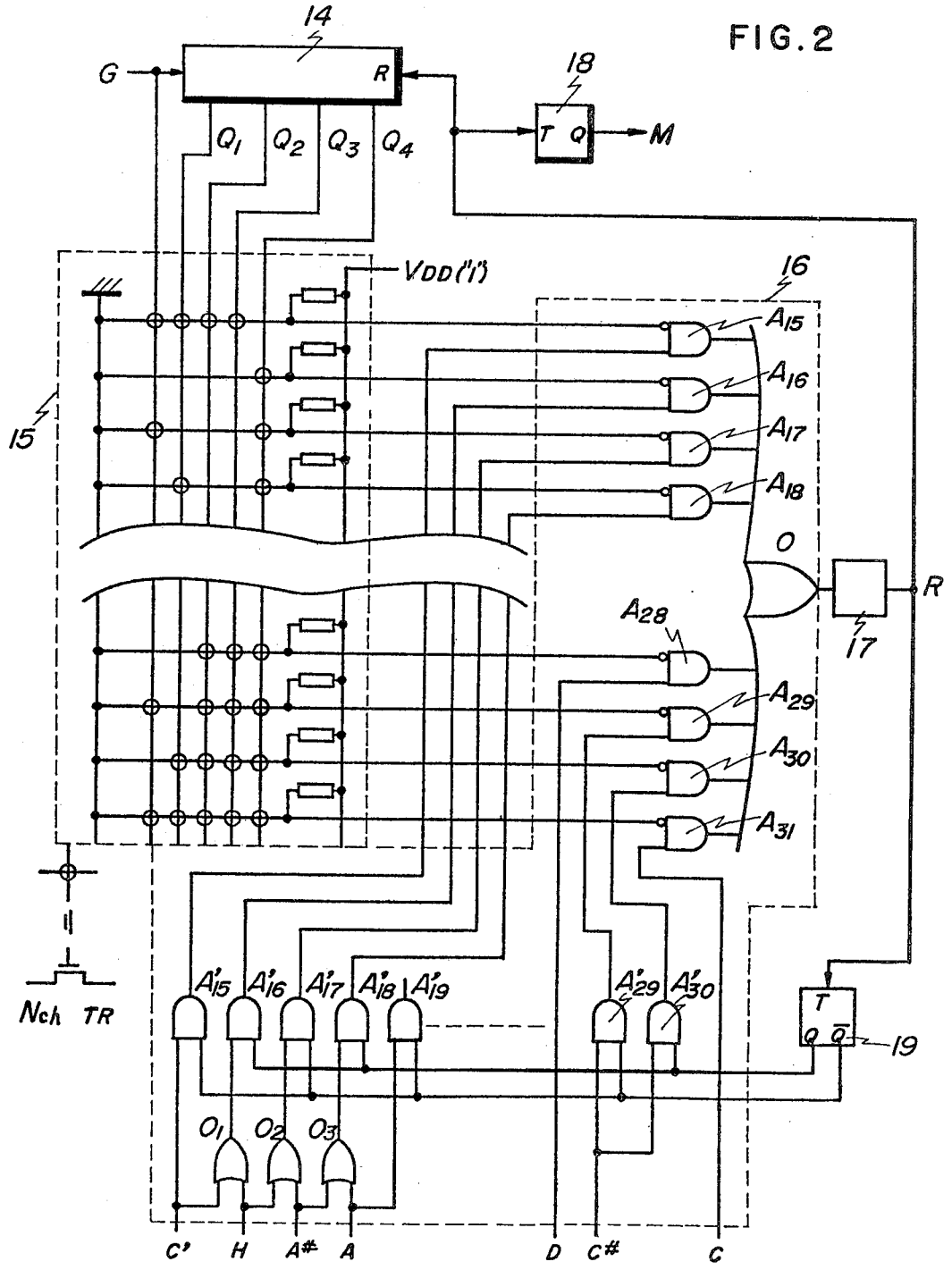
FIG. 2 is a block diagram showing details of a basic portion of the embodiment of FIG. 1.

FIG. 2 illustrates details of the scale frequency generator 12. Apart from the timekeeping divider 2 there is further provided a divider 14 which comprises four stage flip flops responsive to the standard signal G from the standard signal generator 1. The Q outputs of the respective stages are sent to a division ratio control 15. The division ratio control 15 may be implemented with a ROM matrix which comprises a large number of N channel MOS transistors. The division ratio control 15 is programmed to produce logic "0" level outputs at the respective output lines thereof when the logic conditions of the standard signal G and the outputs of the respective stage $Q_1$, $Q_2$, $Q_3$ and $Q_4$ meet "01111", "10000", . . . "11111". It will be noted that these logic conditions correspond to respective ones of division ratios from 15 ("01111") up to 31 ("11111"). A logic "0" level signal is sequentially developed at the respective output lines each time the counting operation of the divider 14 starting with the initial condition thereof ("00000") reaches the end of the first half of corresponding unit cycles each decided by the respective division ratios.

AND logic gates $A_{15}$–$A_{31}$ contained within a division ratio selection control 16 receive the reversed outputs of the respective output lines of the ROM matrix as one inputs and the scale control signals C, C#, D, . . . H, C' as other inputs and calls the output signals from the ROM matrix according to the scale control signals. The outputs thus called are led to a reset pulse generator 17 which is adapted to reset the divider 14 at every occurrence of a reset signal R and thus each time the first half of the unit cycle corresponding to the selected one of the division ratio has passed. In conclusion, these serve as a variable divider of which the division ratio is equal to one half the one selected by the AND logic gates $A_{15}$–$A_{31}$ of the division ratios listed in Table 1. The reset pulse R is the output of this variable devider. In other words, the reset pulse R serves to derive a frequency signal twice as the frequency corresponding to the division ratio on Table 1 from the standar signal G.

A T flip flop 18 serves as a shaping circuit 18 to divide the reset pulse R from the reset pulse generator 17 by two and form a ½ duty pulse, developing the pseudo frequency signals M corresponding to the respective scales on Table 1.

Figure 3:
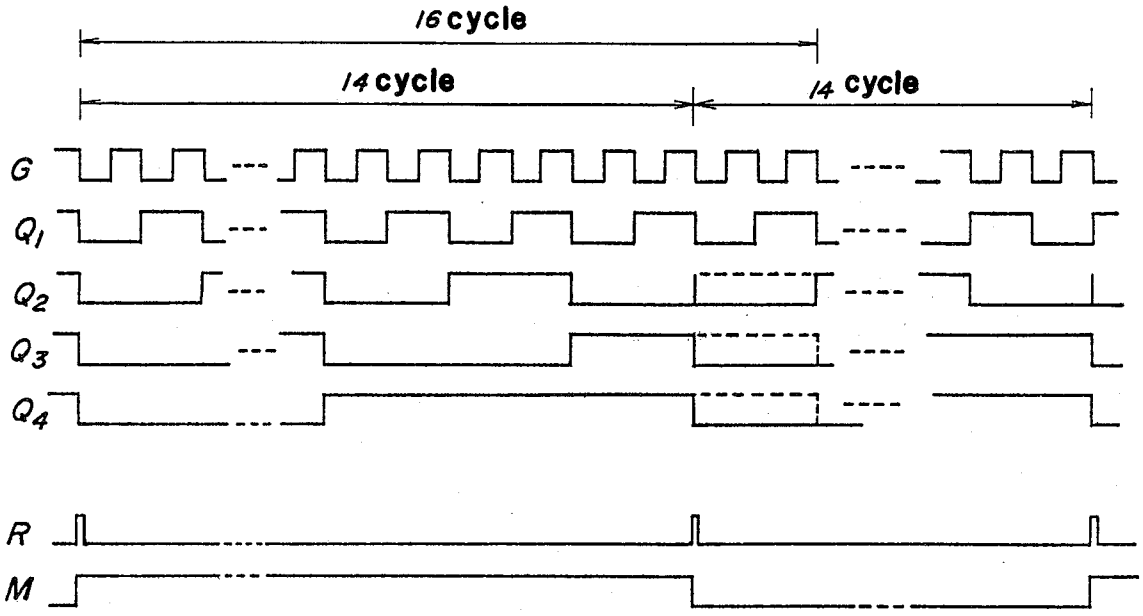
FIG. 3 is a timing diagram of waveforms of various signals occurring within FIG. 1.

By way of example, the pseudo scale frequency signal M of 1170.3 Hz substantially indicative of the Dsound (1176 Hz) will be developed in the following manner. It is clear from Table 1 that the division ratio effective to obtain the pseudo D sound scale from 32.768 kHz is 28. The AND logic gate $A_{28}$ is turned on upon receipt of the scale control signal D so that only the outputs from the corresponding output line of the ROM matrix is supplied to the reset pulse generator 17, resetting the divider 14 at every 14th cycle (28/2=14) of the standard signal G. This event is depicted in a timing diagram of FIG. 3. The reset pulse R is supplied to the shaping flip flop 18, carrying out 2/1 frequency division to form the ½ duty pulse. The result is the frequency signal M of 1170.3 Hz which is 1/28 divided from the standar signal G.

It is obvious from Table 1 that the respective scales of the C#, D#, F, A#, H, C' sounds, etc., are apparently obtainable through a combination of two division ratios. The T flip flop 19 of FIG. 2 responsive to the reset pulse R is provided for controlling the division ratios. The corresponding two of the AND logic gates $A_{15}$–$A_{31}$ are switched on alternatively with respect to each other through the AND gates $A_{15}'$–$A_{19}'$, $A_{23}'$, $A_{24}'$, $A_{26}'$, $A_{27}'$, $A_{29}'$, $A_{30}'$ ($A_{23}'$, $A_{24}'$, $A_{26}'$, $A_{27}'$ are not illustrated).

In the case of the C# sound, the scale control signal C# is applied to the AND logic gates $A_{30}'$, $A_{29}'$, selecting alternatively the AND logic gates $A_{30}$, $A_{29}$, selecting alternatively the AND logic gates $A_{30}$, $A_{29}$ according to the respective output Q and $\overline{Q}$from the division ratio controlling flip flop 19 which is inverted each time the reset pulse R is generated. As a result, the divider 14 effects 1/15 division and 1/14.5 division repeatedly and alternatively.

OR logic gates $O_1$–$O_3$ are provided for taking account of the fact that adjacent two scales are dependent upon the same division ratio, for example, the A and A# sounds in combination and the H and C' sounds in combination. The output logic for the AND logic gates $A_{15}'$–$A_{19}'$ is tabulated as follow:

TABLE 2

| AND logic gate | output logic |
|---|---|
| $A_{15}'$ | $\overline{Q}\cdot C'$ |
| $A_{16}'$ | $Q\cdot(C' + H)$ |
| $A_{17}'$ | $\overline{Q}\cdot(H + A^{\#})$ |
| $A_{18}'$ | $Q\cdot(A^{\#} + A)$ |
| $A_{19}'$ | $\overline{Q}\cdot A$ |

Assume now that the scale control signal A# corresponding to the A# sound is applied. The AND logic gates $A_{17}'$ and $A_{18}'$ and b placed into the on condition through the OR gates $O_2$ and $O_3$. As stated above, the AND logic gates $A_{17}$ and $A_{18}$ are alternatively selected in response to the outputs Q and $\overline{Q}$from the division ratio controlling flip flop 19.

In the case where the pseudo scale is established by a combination of two division ratios, the pseudo scale frequency signal M available from the shaping flip flop 18 is not accurately the pulse waveform of a ½ duty factor. This error corresponds to the half cycle of the standard signal G and is negligible. The division ratio controlling flip flop 19 may be responsive to the frequency signal M to reverse in state in order to produce the pseudo scale frequency signals as defined in Table 1 on the average.

FIG. 14 is detailed circuit diagram of the melody control circuit 11. The melody control circuit 11 consists of a timing decoder section 20 and a scale control signal generator section 21, the former containing an N channel MOS transistor ROM matrix and the latter containing a P-channel MOS transistor ROM matrix. Signals $S_1$–$S_6$ applied to the timing decoder section 20 correspond to the divider outputs and the timekeeping outputs of FIG. 1. That is, the decoder section 20 receives the 4 Hz ($\frac{1}{4}$ sec) signal $S_1$, the 2 Hz ($\frac{1}{2}$ sec) signal $S_2$, and the 1 Hz (1 sec) signal $S_3$ as the devider outputs and the 2 sec signal $S_4$, the 4 sec signal $S_5$ and the 8 sec signal $S_6$ as the timekeeping outputs. The timing decoder section may be programmed at an interval of at least $\frac{1}{8}$ sec and for a period of 8 sec.

Reverting to FIG. 1, when the timekeeping contents of the timekeeping counter 3 agree with the alarm time contained within the alarm time memory circuit 6, the agreement decision circuit 6 is activated to urge the RS flip flop into the set position, permitting the divider output and the timekeeping outputs to enter into the melody control circuit 11 via the gate circuit 10.

Figure 4:
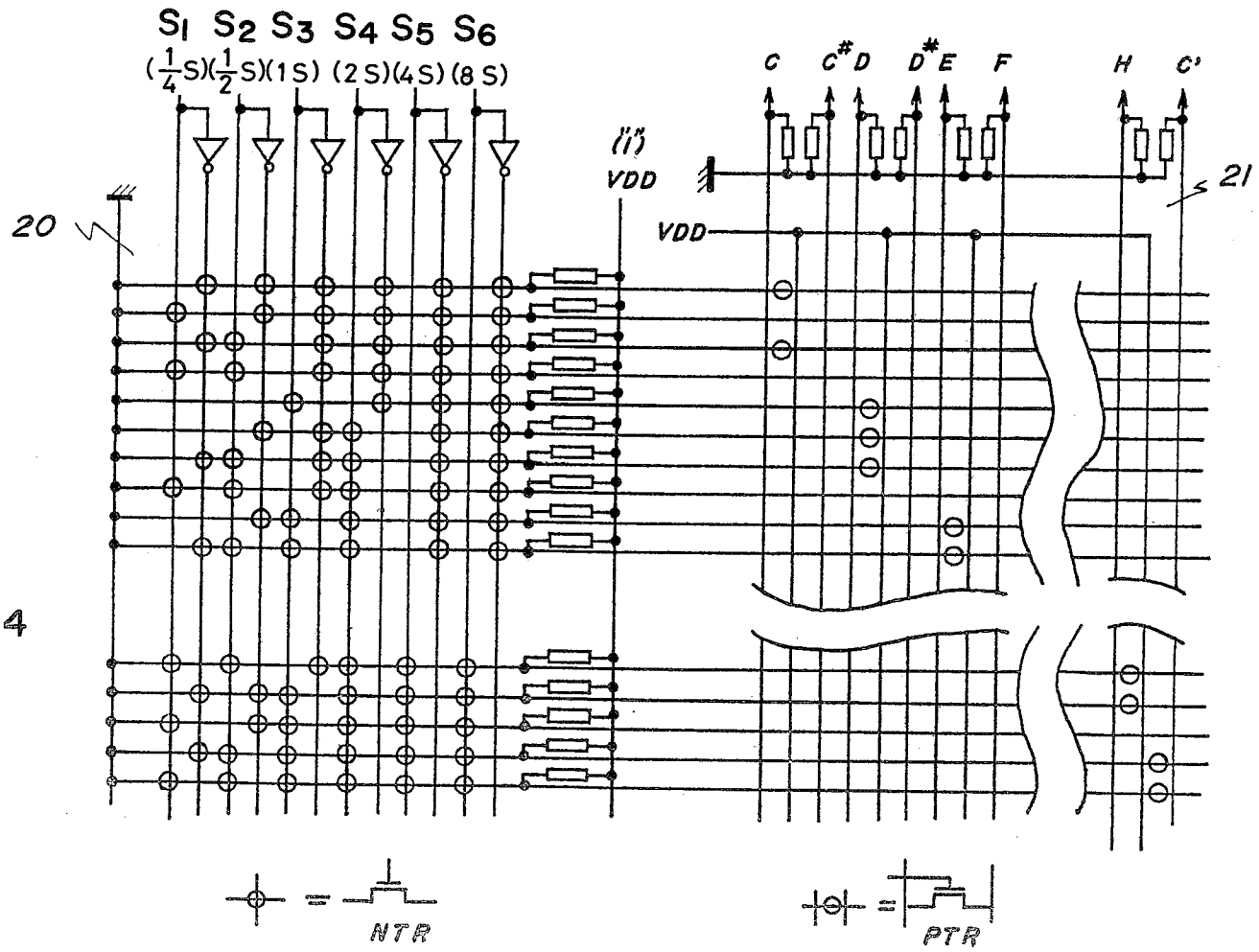
FIG. 4 is a block diagram showing details of another basic portion of the embodiment of FIG. 1.

If the divider outputs and the timekeeping outputs and in other words $S_1$–$S_6$— of FIG. 4. are all at a logic "0" level, the respective output lines of the ROM matrix within the timing decoder section 20 provide the "0" level output in sequence pursuant to the stored program with the elapse of time. At the same time the ROM matrix within the scale control signal generator section 21 selects the musical scale and develops the scale control signals C, C#, D, . . . H, C' for the scale generator circuit 12.

Under the assumption that the quarter note is one second long, the shortest step of $\frac{1}{8}$ seconds is equal to length of the thirty-second note, making it possible to program all scales equal to or longer than the thirty-second note. However, in the case where the same scale is developed in succession, it is necessary to insert a definite distinction between the respective ones of the notes and insert a pause equal to the time duration of the thirty-second note at last. It is preferable to program musical notes in terms of a total length of the indivisual notes. In this instance, musical notes equal to or longer the sixteenth note are programmable and for example the sixteenth note in the form of a thirty-second note + a thirty-second note and the eighth note in the form of a thirty-second × 3 + a thirty-second.

Control for the sound duration is mask-programmable in either the ROM matrix of the timing decoder section 20 or the counterpart of the scale control signal generator section 21. Provided that the respective output lines of the timing decoder section 20 provide the "0" level outputs each time $\frac{1}{8}$ seconds have passed, the sound durations of the respective scales may be programmed at the intersections of the respective output lines of the scale control signal generator section 21 each supplying the individual scale control signals except for the last pause period corresponding to the duration of the thirty second note. In designing the duration program any desired steps can be omitted from the timing decoder section 20.

Figure 5:
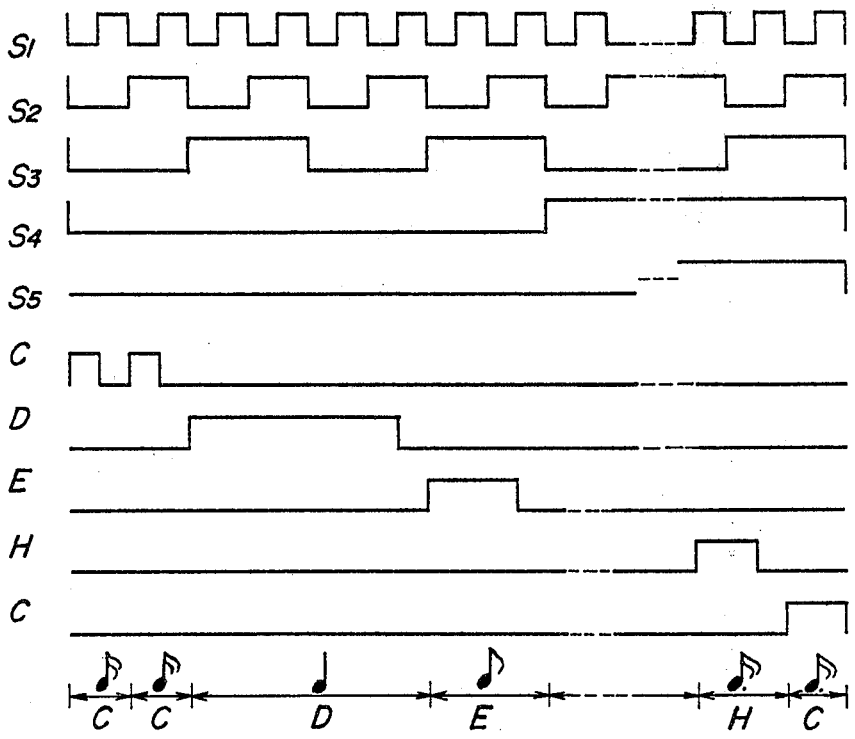
FIG. 5 is a timing diagram of various signals occurring within FIG. 4.

FIG. 5 illustrates various events during the procedure where the scale control signals are developed in the circuit of FIG. 4. In the given example the quarter note ♩ is represented in terms of one second. Although the scale control signal C concerning the C sound actually longs for $\frac{1}{8}$ seconds corresponding to the thirty-second note, a thirty-second rest note is added just after the control signal C to provide a definite break in the successive generation of sounds with the total duration being equal to that of a sixteenth note. This is true to the other scale control signals D, E, H, C, etc. In order to develop the scale control signal D concerning the D sound for the period corresponding to the quarter note, a logic condition (001xx) is incorporated into the timing decoder section 20 corresponding to the initial program location of the scale control signal generator section 21. Four steps (00100), (00101), (00110) and (00111) are derived from a signal output line. Another logic condition (0100x) is also incorporated into the next succeeding program location, permitting two steps (01000) and (01001) to be derived from a common output line. This allows eliminating of some steps. This is equally applicable to an eighth note of the E sound. Such eliminating of the step number is effective to simplification of circuit construction of the timing decoder section 20 and the scale control signal generator section 21. In this manner, the melody control circuit 11 may be programmed to meet the user's taste at the user's option through the utilization of the ROM matrix. The contents of the stored program are alterable by using an erasible mask programmable ROM (EPROM) matrix or an electrically erasible programmable ROM (EEPROM) matrix.

The generation of a melody will come to a stop by setting the RS flip flop 9 of FIG. 1 in response to the output derived from the final step of the timing decoder 20. As well this can be accomplished by an externally controlled switch.

Although in the given embodiment the alarming melody is provided when the alarm time is in agreement with the time information in the timekeeping circuit, arrival of a given time can be also announced in the form of an appropriate melody by utilization of the above discussed concept of the present invention.

Figure 6:
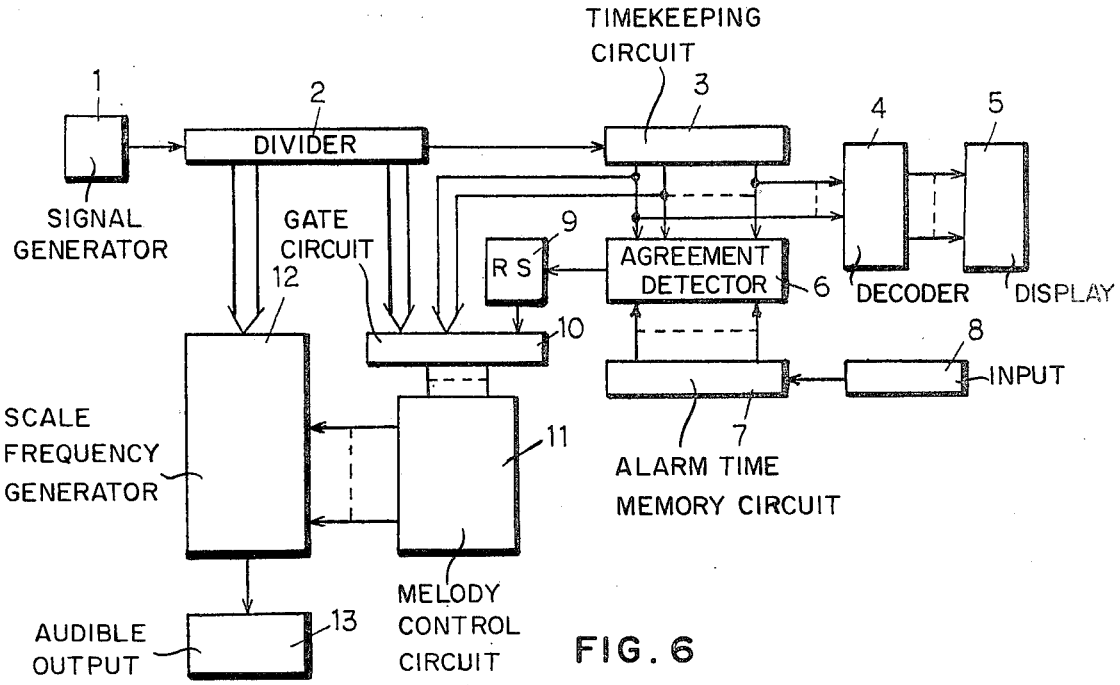
FIGS. 6 and 7 are block diagrams of another preferred embodiment of the present invention.
Figure 7:
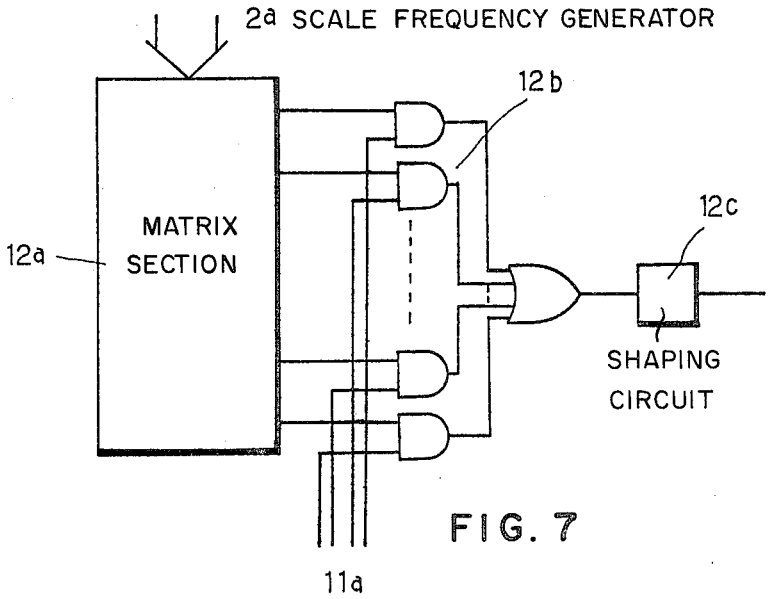

It is also obvious that the scale frequencies of the C sound to C' sound may be substantially copied from the outputs of the timekeeping dividers responsive to the standard signals without using the divider 14 in the generator 12. As seen from FIGS. 6 and 7, a modified scale frequency generator 12 consists of a matrix section 12 responsive to an output **2*a* of a particular stage, AND-OR logic gates 12*b* for selection of the matrix output in response to a scale control signal 11*a* and a shaping circuit section 12*c*** for controlling a duty factor, etc. It is also apparent that the scale frequency signal generator means and the timekeeping counter may be incorporated onto a single LSI chip or two discrete LSI chips.

The invention being thus described, it will be obvious that the same may be varied in many ways. Such modifications are not to be regarded as a departure from the spirit and scope of the invention, and all such modifications are intended to be included within the scope of the following claims.

What is claimed is:

1. An electronic timepiece comprising:

alarm time sensing means for generating an alarm signal at a preselected time of day;

tune storage means for storing information indicative of a desired series of musical notes, said tune storage means providing a series of musical note signals in response to the generation of an alarm signal by said alarm time sensing means;

a frequency generator for generating a high frequency time standard signal;

a frequency divider connected to said frequency generator, said frequency divider including a fixed division rate divider including N stages, each of said stages having an output, said divider having a reset terminal;

means for combining the outputs of said divider in a selected manner to produce a signal having a desired frequency representative of a desired musical note;

means for selecting the manner in which the outputs of said divider are to be combined in order to select one of a plurality of desired frequencies, each corresponding to each desired musical note and its associated musical note signal produced by said tune storage means, said means for selecting including, an M row×N column switch array, the N columns of said array being driven by said divider stage outputs, the M rows of said array being connected through a note enabling circuit to the reset terminal of said divider, the switches of said array being selectively enabled to produce a count at said reset terminal corresponding to the division ratio necessary to produce said desired frequency corresponding to that row, and note selection means responsive to said musical note signals and controlling said note enabling circuit for enabling at least one row of said array to thereby select said desired frequency; and an audio generator for generating an audible musical note upon application of each desired frequency from said divider, said audio generator producing a musical tune by the successive generation of said desired series of musical notes.

2. An electronic timepiece alarm for an electronic timepiece including a frequency generator which produces a high frequency time standard signal, said alarm comprising:

alarm time sensing means for generating an alarm signal at a selected time of day;

tune storage means for storing information indicative of a desired series of musical notes, said tune storage means providing a series of musical note signals in response to the generation of an alarm signal by said alarm time sensing means;

a frequency divider connected to said frequency generator said signal frequency divider including a fixed division ratio divider including N stages, each of said stages having an output, said divider having a reset terminal;

means for combining the outputs of said divider in a selected manner to produce a signal having a desired frequency representative of a desired musical note;

means for selecting the manner in which the outputs of said divider are to be combined in order to select one of a plurality of desired frequencies, each corresponding to each desired musical note and its associated musical note signal produced by said tune storage means, said means for selecting including, an M row×N column switch array, the N columns of said array being driven by said divider stage outputs, the M rows of said array being connected through a note enabling circuit to the reset terminal of said divider, the switches of said array being selectively enabled to produce a count at said reset terminal corresponding to the division ratio necessary to produce said desired frequency corresponding to that row, and note selection means responsive to said musical note signals and controlling said note enabling circuit for enabling at least one row of said array to thereby select said desired frequency; and an audio generator for generating an audible musical note upon application of each desired frequency from said divider, said audio generator producing a musical tune by the successive generation of said desired series of musical notes.

3. The alarm of claims 1 or 2 wherein said alarm time sensing means comprises:

alarm time storage means for storing a signal indicative of a desired alarm time;

means for providing a signal indicative of the actual time of day; and means for comparing the signal indicative of said desired alarm time with the signal indicative of the actual time of day and producing an alarm signal upon coincidence thereof.

4. The timepiece of claim 1 or 2 wherein said high frequency time standard signal of said frequency generator is applied to said single frequency divider.

5. The device of claims 1 or 2 further comprising:

timekeeping means for dividing said high frequency time standard signal to produce timing signals and for converting said timing signals into time information signals;

display means for indicating the time of day in response to receipt of said time information signals.

6. The device of claim 5 wherein said note selection means includes note duration determination means responsive to said timing signals for determining the duration of said desired musical note and its associated note signal.

7. The device of claim 6 wherein said note selection means includes note duration determination means responsive to said timing signals for determining the duration of said desired musical note and its associated note signal.

8. The device of claim 7 wherein said note duration determination means includes:

a X row×Y column switch array, the Y columns of said array being driven by said timing signals, the X rows of said array producing note duration signals representing the duration of desired musical notes to be sequentially generated.

9. The device of claim 8 wherein said note enabling circuit includes frequency determination means responsive to said note duration signals for determining the pitch of each of said desired musical notes to be sequentially generated.

10. The device of claim 9 wherein said frequency determination circuit includes:

a J row×K column switch array, the J rows of said array being connected to associated rows of said X row×Y column array to receive said note duration signals therefrom, the J rows of said array providing enabling signals to said note enabling circuit, the switches of said array being arranged to produce a sequence of enabling signals representative of desired frequencies and durations.

11. An electronic timepiece comprising:

alarm time sensing means for generating an alarm signal at a desired time of day;

tune storage means for storing information indicative of a desired series of musical notes, said tune storage means providing a series of musical note signals in response to the generation of the alarm signal by said alarm time sensing means;

a frequency generator for generating a high frequency time standard signal;

timekeeping means for dividing said high frequency time standard signal to produce timing signals and for converting said timing signals into time information signals;

display means for indicating the time of day in response to receipt of said time information signals;

a frequency divider connected to said frequency generator and responsive to said high frequency time standard signal and having a plurality of outputs;

means for combining the outputs of said divider in a selected manner to produce a signal having a desired frequency representative of a desired musical note;

means for selecting the manner in which the outputs of said divider are to be combined in order to select one of a plurality of desired frequencies, each corresponding to each desired musical note and its associated musical note signal produced by said tune storage means; and an audio generator for generating an audible musical note upon application of each desired frequency from said divider, said audio generator producing a musical tune by the successive generation of said desired series of musical notes.

* * * * *